US012736279B2

(12) United States Patent
Baik et al.

(10) Patent No.: US 12,736,279 B2
(45) Date of Patent: Sep. 15, 2026

(54) HYDROGEN LIQUEFACTION SYSTEM AND HYDROGEN LIQUEFACTION METHOD

(71) Applicant: H2CREO Corp., Dover, DE (US)

(72) Inventors: Jong H Baik, Titusville, FL (US); Ho-Myung Chang, Seoul (KR); Hyung Jin Kim, Gyeonggi-do (KR)

(73) Assignee: H2CREO CORP., Dover, DE (US)

( * ) Notice: Subject to any disclaimer, the term of this patent is extended or adjusted under 35 U.S.C. 154(b) by 303 days.

(21) Appl. No.: 18/405,764

(22) Filed: Jan. 5, 2024

(65) Prior Publication Data

US 2024/0318904 A1 Sep. 26, 2024

Related U.S. Application Data

(60) Provisional application No. 63/454,157, filed on Mar. 23, 2023.

(51) Int. Cl.
*F25J 1/00* (2006.01)
*F25J 1/02* (2006.01)

(52) U.S. Cl.
CPC ..... *F25J 1/001* (2013.01); *F25J 1/0065* (2013.01); *F25J 1/0262* (2013.01); *F25J 2205/82* (2013.01); *F25J 2245/02* (2013.01)

(58) Field of Classification Search
CPC .. F25J 1/001; F25J 1/005; F25J 1/0065; F25J 1/0204; F25J 1/0221; F25J 1/0245;
(Continued)

(56) References Cited

U.S. PATENT DOCUMENTS 2,937,076 A * 5/1960 Class ..... F25J 1/0045 62/607
3,380,809 A * 4/1968 Newton ..... F25J 1/0072 62/607

(Continued)

FOREIGN PATENT DOCUMENTS

KR 20000021120 A 4/2000
KR 2021-0064902 A 6/2021
KR 2021-0126800 A 10/2021

OTHER PUBLICATIONS

Kim et al., "Thermodynamic Analysis of a Hydrogen Liquefaction Process for a Hydrogen Liquefaction Pilot Plant with a Small Capacity", trans. of Korean Hydrogen and New Energy Society, vol. 31, No. 1, 2020, pp. 41-48.

*Primary Examiner* — Filip Zec
(74) *Attorney, Agent, or Firm* — Moser Taboada

(57) ABSTRACT

The present disclosure relates to a hydrogen liquefaction system and hydrogen liquefaction method optionally enabling O-P conversion in a hydrogen liquefaction process, and may include: a hydrogen pipe, where gaseous hydrogen is introduced at a front end, heat exchange occurs in a heat exchange section leading to liquefaction of gaseous hydrogen into liquid hydrogen, and liquefied liquid hydrogen can be discharged at a rear end; a cooling cycle device that is in thermal contact with the heat exchange section of the hydrogen pipe so as to perform heat exchange with the heat exchange section of the hydrogen pipe such that gaseous hydrogen can be liquefied into liquid hydrogen; and an Ortho-Para (O-P) converter formed in the hydrogen pipe, converting a ratio of ortho-hydrogen to para-hydrogen in a process of liquefying gaseous hydrogen into liquid hydrogen.

13 Claims, 12 Drawing Sheets

(58) Field of Classification Search
CPC ..... F25J 1/0254; F25J 1/0259; F25J 1/0262; F25J 2205/82; F25J 2210/06; F25J 2210/42; F25J 2245/02; F25J 2270/16; C01B 3/0089
See application file for complete search history.

(56) References Cited

U.S. PATENT DOCUMENTS 3,992,167 A * 11/1976 Beddome ..... F25J 1/025 505/895
6,126,794 A * 10/2000 Chambers ..... C25B 1/044 204/278
6,523,366 B1 * 2/2003 Bonaquist ..... F25J 1/0257 62/613
9,598,946 B2 * 3/2017 Shomody ..... F25J 3/0247
10,890,375 B2 * 1/2021 Chambron ..... F25J 1/0037
10,928,127 B2 * 2/2021 Cardella ..... F25J 1/025
11,204,196 B2 * 12/2021 Ebert ..... F25J 1/0271
11,391,511 B1 * 7/2022 Thomas ..... F25J 1/0288
2004/0112083 A1 * 6/2004 Bracha ..... F25J 1/001 62/611
2008/0196587 A1 * 8/2008 Ha ..... F25J 3/04533 203/99
2010/0083695 A1 * 4/2010 Kundig ..... F25J 1/001 62/607
2010/0272634 A1 * 10/2010 Schwartz ..... C01B 3/0089 422/187
2014/0053598 A1 * 2/2014 Ishimaru ..... F25J 1/001 62/606
2016/0200570 A1 * 7/2016 Leachman ..... B01J 19/2405 422/222
2020/0141637 A1 * 5/2020 Turney ..... F25J 1/005
2023/0067883 A1 * 3/2023 Han ..... F25J 1/023

* cited by examiner

HYDROGEN LIQUEFACTION SYSTEM AND HYDROGEN LIQUEFACTION METHOD

CROSS-REFERENCE TO RELATED APPLICATIONS

The present application claims the benefit of and priority to U.S. Provisional Application Ser. No. 63/454,157, filed on Mar. 23, 2023, the entire contents of which is incorporated herein by reference.

BACKGROUND

1. Field of the Invention

The present disclosure relates to a hydrogen liquefaction system and hydrogen liquefaction method, and more particularly, to a hydrogen liquefaction system and hydrogen liquefaction method that optionally enable Ortho-Para (O-P) conversion in a hydrogen liquefaction process.

2. Description of the Related Art

Liquid hydrogen, offering increased storage density compared to high-pressure gaseous hydrogen, is experiencing growing demand as a replacement fuel for vehicles that currently use high-pressure gaseous hydrogen. Particularly, liquid hydrogen is widely used in an aerospace industry as a rocket propellant and is expected to be widely used in trucks, buses, ships, and aircraft in the future.

Meanwhile, hydrogen is a two-atom molecule and can exist in two molecular forms, ortho-hydrogen (O-hydrogen) and para-hydrogen (P-hydrogen), depending on an electron spin direction of each atom.

At room temperature (300 K), P-hydrogen and O-hydrogen are in equilibrium of a ratio of 25 percent to 75 percent, and hydrogen in this ratio is referred to as normal hydrogen (N-hydrogen). However, in a hydrogen liquefaction process, the equilibrium ratio of P-hydrogen gradually increases with decreasing temperature, eventually reaching 99.9 percent at liquid hydrogen temperature (20 K). Since P-hydrogen in a liquid state has a lower energy level than O-hydrogen, O-P conversion can occur together during a liquefaction process to obtain liquid hydrogen in equilibrium condition.

However, O-P conversion is a very slow process, and catalysts can be used to speed up the conversion. Meanwhile, since heat is generated during O-P conversion, additional cooling power is required to maintain the liquid state.

Therefore, depending on a storage period for liquid hydrogen, conventional hydrogen liquefaction devices may use a general hydrogen liquefaction device that liquefies N-hydrogen as it is, without O-P conversion, e.g., for short-term storage applications where liquefied hydrogen is consumed within a few days.

On the other hand, in order to prevent loss of stored liquids for very long storage periods, such as two weeks or more, or for long-distance transportation, a separate hydrogen liquefaction device with O-P conversion is used to produce liquid hydrogen that is equilibrium hydrogen through O-P conversion, although the efficiency is low due to high energy consumption.

SUMMARY

The present disclosure is to resolve various problems including the above problem, and has a purpose of providing a hydrogen liquefaction system and hydrogen liquefaction method capable of producing liquid hydrogen in a normal state in a bypass mode by allowing an O-P conversion process to be optionally performed as needed using a bypass device in a hydrogen liquefaction process, capable of producing liquid hydrogen in equilibrium condition in an O-P conversion mode, and further capable of increasing conversion efficiency by cooling O-P conversion heat using an external heat exchange chamber. However, these problems are exemplary, and a scope of the present disclosure is not limited thereto.

The hydrogen liquefaction system according to one aspect of the present disclosure for resolving the above problems may comprise a hydrogen pipe, where gaseous hydrogen is introduced at a front end, heat exchange occurs in a heat exchange section leading to liquefaction of gaseous hydrogen into liquid hydrogen, and liquefied liquid hydrogen can be discharged at a rear end; a cooling cycle device that is in thermal contact with the heat exchange section of the hydrogen pipe so as to perform heat exchange with the heat exchange section of the hydrogen pipe such that gaseous hydrogen can be liquefied into liquid hydrogen; and an Ortho-Para (O-P) converter formed in the hydrogen pipe, converting a ratio of ortho-hydrogen to para-hydrogen in a process of liquefying gaseous hydrogen into liquid hydrogen.

Additionally, according to one embodiment of the present disclosure, the hydrogen liquefaction system may further comprise a bypass device formed in the hydrogen pipe such that gaseous hydrogen or liquid hydrogen can optionally bypass the O-P converter.

Additionally, according to one embodiment of the present disclosure, the cooling cycle device may include: a circulating line in which helium circulates; a compressor formed in the circulating line, compressing helium; an aftercooler formed in the circulating line, cooling compressed helium to release heat; a first expander formed in the circulating line, expanding compressed helium such that temperature of helium is firstly lowered; a second expander formed in the circulating line, expanding compressed helium such that temperature of helium is secondly lowered; a first heat exchanger formed between the aftercooler and the first expander, performing heat exchange with the hydrogen pipe; and a second heat exchanger formed between the first expander and the second expander, performing heat exchange with the hydrogen pipe.

Additionally, according to one embodiment of the present disclosure, the O-P converter may include: a first O-P converter formed between the first heat exchanger and the second heat exchanger, and the bypass device may include: a first bypass device formed between the first heat exchanger and the second heat exchanger so as to optionally bypass the first O-P converter.

Additionally, according to one embodiment of the present disclosure, the first bypass device may include a first bypass line that bypasses the first O-P converter; a first bypass valve formed at a front end of the first bypass line so as to optionally open or close any one of the hydrogen pipe that is connected to the first O-P converter, or the first bypass line; and a second bypass valve formed at a rear end of the first bypass line so as to optionally open or close any one of the hydrogen pipe that is connected to the first O-P converter, or the first bypass line.

Additionally, according to one embodiment of the present disclosure, the cooling cycle device may further include a third heat exchanger formed between the second expander and the second heat exchanger, performing heat exchange with the hydrogen pipe.

Additionally, according to one embodiment of the present disclosure, the O-P converter may further include a second O-P converter formed in the hydrogen pipe, after the hydrogen pipe passes through the third heat exchanger and before it re-enters the third heat exchanger, and the bypass device may further include a second bypass device formed in the hydrogen pipe, after the hydrogen pipe passes through the third heat exchanger and before it re-enters the third heat exchanger, so as to optionally bypass the second O-P converter.

Additionally, according to one embodiment of the present disclosure, the second bypass device may include a second bypass line that bypasses the second O-P converter; a third bypass valve formed at a front end of the second bypass line so as to optionally open or close any one of the hydrogen pipe that is connected to the second O-P converter, or the second bypass line; and a fourth bypass valve formed at a rear end of the second bypass line so as to optionally open or close any one of the hydrogen pipe that is connected to the second O-P converter, or the second bypass line.

Additionally, according to one embodiment of the present disclosure, the O-P converter may be a catalytic converter formed outside the cooling cycle device.

Additionally, according to one embodiment of the present disclosure, the O-P converter may be formed in the hydrogen pipe that protrudes to outside from the cooling cycle device, being formed to be surrounded by a heat exchange chamber.

Additionally, according to one embodiment of the present disclosure, the heat exchange chamber may be a vacuum chamber, which includes: a liquid nitrogen supply pipe formed on one side so as to perform heat exchange by using low-temperature liquid nitrogen or latent heat that is generated when liquid nitrogen is vaporized into gaseous nitrogen; and a gaseous nitrogen discharge pipe formed on the other side.

Additionally, according to one embodiment of the present disclosure, the cooling cycle device may include a circulating line in which helium circulates; a compressor formed in the circulating line, compressing helium; an aftercooler formed in the circulating line, cooling compressed helium to release heat; a first expander formed in the circulating line, expanding compressed helium such that temperature of helium is firstly lowered; a second expander formed in the circulating line, expanding compressed helium such that temperature of helium is secondly lowered; a first heat exchanger formed between the aftercooler and the first expander, performing heat exchange with the hydrogen pipe; a second heat exchanger formed between the first expander and the second expander, performing heat exchange with the hydrogen pipe; and a third heat exchanger formed between the second expander and the second heat exchanger, performing heat exchange with the hydrogen pipe.

Additionally, according to one embodiment of the present disclosure, the heat exchange chamber may include a first heat exchange chamber formed to be detachable in the hydrogen pipe, which is exposed to outside of the cooling cycle device, between the first heat exchanger and the second heat exchanger, having a third O-P converter formed therein; and a second heat exchange chamber formed to be detachable at the rear end of the hydrogen pipe or formed to be detachable with the cooling cycle device by forming a second Cold Box with the first heat exchange chamber, having a fourth O-P converter formed therein.

Additionally, according to one embodiment of the present disclosure, the second heat exchange chamber may be in thermal contact with a circulating line, which protrudes to outside of the cooling cycle device, between the second expander and the third heat exchanger so as to perform heat exchange with the circulating line, or forms a second Cold Box with the first heat exchange chamber to be detachable in the cooling cycle device.

Additionally, according to one embodiment of the present disclosure, the circulating line, which protrudes to outside of the cooling cycle device between the second expander and the third heat exchanger, may have a branch point and a junction point so as to be connected in parallel with the circulating line, which is connected with the third heat exchanger, between the second expander and the third heat exchanger.

Additionally, according to one embodiment of the present disclosure, the bypass device may further include a third bypass device formed in the hydrogen pipe between the first heat exchanger and the second heat exchanger so as to optionally bypass the third O-P converter; and a fourth bypass device formed at a rear end of the hydrogen pipe so as to optionally bypass the fourth O-P converter.

Additionally, according to one embodiment of the present disclosure, the O-P converter may be formed in any one or more of following locations: inside of the first heat exchanger, inside of the second heat exchanger, inside of the third heat exchanger of the cooling cycle device, in the hydrogen pipe between the first heat exchanger and the second heat exchanger, or in the hydrogen pipes between the second heat exchanger and the third heat exchanger, or a combination of these locations.

Meanwhile, a hydrogen liquefaction method according to one aspect of the present disclosure for resolving the above problems may comprise (a) preparing a hydrogen pipe, where gaseous hydrogen is introduced at a front end, heat exchange occurs in a heat exchange section leading to liquefaction of gaseous hydrogen into liquid hydrogen, and liquefied liquid hydrogen can be discharged at a rear end; (b) liquefying gaseous hydrogen into liquid hydrogen, in which heat exchange with the heat exchange section of the hydrogen pipe is performed by using a cooling cycle device that is in thermal contact with the heat exchange section of the hydrogen pipe; and (c) converting a ratio of ortho-hydrogen to para-hydrogen inside the hydrogen pipe by using an O-P converter in a process of liquefying gaseous hydrogen into liquid hydrogen.

Additionally, according to one embodiment of the present disclosure, the hydrogen liquefaction method may further comprise: before or after (c), (d) gaseous hydrogen or liquid hydrogen optionally bypassing the O-P converter by using a bypass device that is formed in the hydrogen pipe.

Meanwhile, the hydrogen liquefaction system according to one aspect of the present disclosure for resolving the above problem may comprise a hydrogen pipe, where gaseous hydrogen is introduced at a front end, heat exchange occurs in a heat exchange section leading to liquefaction of gaseous hydrogen into liquid hydrogen, and liquefied liquid hydrogen can be discharged at a rear end; a cooling cycle device that is in thermal contact with the heat exchange section of the hydrogen pipe so as to perform heat exchange with the heat exchange section of the hydrogen pipe such that gaseous hydrogen can be liquefied into liquid hydrogen; an O-P converter formed in the hydrogen pipe, converting a ratio of ortho-hydrogen to para-hydrogen in a process of liquefying gaseous hydrogen into liquid hydrogen; and a bypass device formed in the hydrogen pipe such that gaseous hydrogen or liquid hydrogen can optionally bypass the O-P converter, wherein the cooling cycle device may include a circulating line in which helium circulates; a compressor formed in the circulating line, compressing helium; an aftercooler formed in the circulating line, cooling compressed helium to release heat; a first expander formed in the circulating line, expanding compressed helium such that temperature of helium is firstly lowered; a second expander formed in the circulating line, expanding compressed helium such that temperature of helium is secondly lowered; a first heat exchanger formed between the aftercooler and the first expander, performing heat exchange with the hydrogen pipe; a second heat exchanger formed between the first expander and the second expander, performing heat exchange with the hydrogen pipe; and a third heat exchanger formed between the second expander and the second heat exchanger, performing heat exchange with the hydrogen pipe, wherein the O-P converter may include: a first O-P converter formed between the first heat exchanger and the second heat exchanger; and a second O-P converter formed in the hydrogen pipe, after the hydrogen pipe passes through the third heat exchanger and before it re-enters the third heat exchanger, the bypass device may include a first bypass device formed between the first heat exchanger and the second heat exchanger so as to optionally bypass the first O-P converter; and a second bypass device formed in the hydrogen pipe, after the hydrogen pipe passes through the third heat exchanger and before it re-enters the third heat exchanger so as to optionally bypass the second O-P converter, wherein the first bypass device may include: a first bypass line that bypasses the first O-P converter; a first bypass valve formed at a front end of the first bypass line so as to optionally open or close any one of the hydrogen pipe that is connected to the first O-P converter, or the first bypass line; and a second bypass valve formed at a rear end of the first bypass line so as to optionally open or close any one of the hydrogen pipe that is connected to the first O-P converter, or the first bypass line, and wherein the second bypass device may include: a second bypass line that bypasses the second O-P converter; a third bypass valve formed at a front end of the second bypass line so as to optionally open or close any one of the hydrogen pipe that is connected to the second O-P converter, or the second bypass line; and a fourth bypass valve formed at a rear end of the second bypass line so as to optionally open or close any one of the hydrogen pipe that is connected to the second O-P converter, or the second bypass line.

According to various embodiments of the present disclosure formed as above, there are effects of producing liquid hydrogen in a normal state, which is advantageous for short-term storage, in a bypass mode by allowing an O-P conversion process to be optionally performed as needed using a bypass device in a hydrogen liquefaction process, producing liquid hydrogen in equilibrium condition, which is advantageous for long-term storage or long-distance transportation, in an O-P conversion mode, and further increasing conversion efficiency by cooling O-P conversion heat using an external heat exchange chamber. However, a scope of the present disclosure is not limited by these effects.

DETAILED DESCRIPTION

Figure 1:
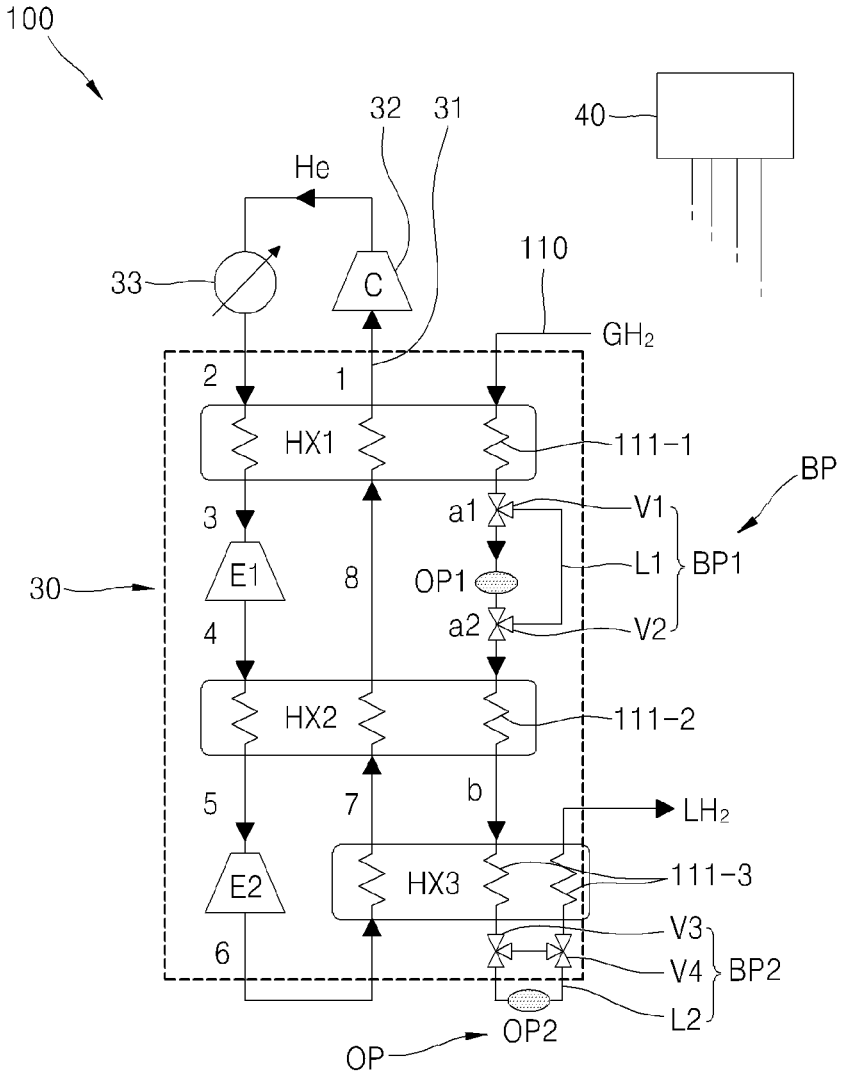
FIG. 1 is a schematic diagram conceptually showing a hydrogen liquefaction system according to some embodiments of the present disclosure.

Hereinafter, various preferred embodiments of the present disclosure will be described in detail with reference to the appended drawings.

The embodiments of the present disclosure are provided to more completely explain the present disclosure to those skilled in the art, and the following embodiments can be modified into various other forms, and the scope of the present disclosure is not limited to the following embodiments. Instead, these embodiments are provided to enhance the faithfulness and completeness of the present disclosure and to fully convey the technical ideas of the present disclosure to those skilled in the art. Furthermore, the thickness and size of each layer in the drawings are exaggerated for convenience and clarity of explanation.

Terms used in the present specification are intended to describe a specific embodiment, and are not intended to limit the present disclosure. As used herein, a singular form may also include a plural form unless the context clearly indicates otherwise. Additionally, as used herein, terms "comprise" and/or "comprising" are intended to specify a presence of mentioned figures, numbers, steps, operations, members, elements, and/or groups thereof and are not intended to exclude a presence or addition of one or more other figures, numbers, operations, members, elements, and/or groups.

Hereinafter, embodiments of the present disclosure will now be described with reference to drawings that schematically show ideal embodiments of the present disclosure. In the drawings, variations of the depicted shape may be expected, for example, depending on manufacturing technology and/or tolerances. Accordingly, embodiments of the present disclosure should not be construed as being limited to the specific shape of the area shown in this specification, but should include, for example, changes in shape resulting from manufacturing.

FIG. 1 is a schematic diagram conceptually showing a hydrogen liquefaction system 100 according to some embodiments of the present disclosure.

First, as shown in FIG. 1, the hydrogen liquefaction system 100 according to some embodiments of the present disclosure may primarily include a hydrogen pipe 110, a cooling cycle device 30, and an O-P converter OP.

The hydrogen pipe 110, for example, forms a type of a hydrogen transport pathway that can transport gaseous hydrogen GH2 or liquid hydrogen LH2, and may be applied with various hydrogen lines, hydrogen transport pipes or hydrogen ducts having a sufficient strength and durability capable of withstanding high-pressure or low-temperature.

The hydrogen pipe 110, for example, as shown in FIG. 1, may be formed long in a longitudinal direction from a front end to a rear end. The hydrogen pipe 110 may be formed with the front end into which gaseous hydrogen GH2 flows, heat exchange sections 111-1 to 111-3 in which heat exchange is performed so that gaseous hydrogen GH2 is liquefied into liquid hydrogen LH2 in a middle, and the rear end through which liquefied liquid hydrogen LH2 is discharged.

However, this hydrogen pipe 110 is not limited to FIG. 1, and may be bent into various shapes or formed into various three-dimensional shapes to suit an installation environment.

Accordingly, when the hydrogen pipe 110 is used, gaseous hydrogen GH2 may flow into the front end and pass through the heat exchange sections 111-1 to 111-3 in the middle, such that gaseous hydrogen GH2 can be liquefied into liquid hydrogen LH2, and then liquefied liquid hydrogen LH2 can be continuously or intermittently discharged through the rear end.

The cooling cycle device 30, for example, may be a device that is in thermal contact with the heat exchange sections 111-1 to 111-3 of the hydrogen pipe 110 so as to perform heat exchange with the heat exchange sections 111-1 to 111-3 of the hydrogen pipe 110 such that gaseous hydrogen GH2 can be liquefied into liquid hydrogen LH2.

The cooling cycle device 30, more specifically, for example, as shown in FIG. 1, may include: a circulating line 31 in which helium He circulates; a compressor 32 formed in the circulating line 31, compressing helium He; an aftercooler 33 formed in the circulating line 31, cooling compressed helium He to release heat; a first expander E1 formed in the circulating line 31, expanding compressed helium He such that temperature of helium He is firstly lowered; a second expander E2 formed in the circulating line 31, expanding compressed helium He such that temperature of helium He is secondly lowered; a first heat exchanger HX1 formed between the aftercooler 33 and the first expander E1, performing heat exchange with the hydrogen pipe 110; a second heat exchanger HX2 formed between the first expander E1 and the second expander E2, performing heat exchange with the hydrogen pipe 110; and a third heat exchanger HX3 formed between the second expander E2 and the second heat exchanger HX2, performing heat exchange with the hydrogen pipe 110.

Therefore, according to the cooling cycle device 30, as shown in FIG. 1, helium He circulates along the circulating line 31 passing through the compressor 32 and aftercooler 33 in a first pathway, the first heat exchanger HX1 in a second pathway, the first expander E1 in a third pathway, the second heat exchanger HX2 in a fourth pathway, the second expander E2 in a fifth pathway, the third heat exchanger HX3 in a sixth pathway, the second heat exchanger HX2 in a seventh pathway, the first heat exchanger HX1 in a eighth pathway, and the compressor 32 in the first pathway again, thereby forming a type of a Cold Box by using latent heat that is generated when compressed helium He expands.

Here, in the hydrogen pipe 110, each of the heat exchange sections 111-1 to 111-3 is in thermal contact with the first heat exchanger HX1, the second heat exchanger HX2 in 'a1', 'a2' pathways, and the third heat exchanger HX3 in a 'b' pathway so as to perform heat exchange, such that gaseous hydrogen GH2 can be liquefied into liquid hydrogen LH2.

However, this cooling cycle device 30 is not necessarily limited to FIG. 1, and may be applied with a wide variety of types and shapes of cooling cycle devices capable of liquefying gaseous hydrogen GH2 into liquid hydrogen LH2.

For example, as shown in FIG. 1, at least one or more O-P converters OP may be formed on one side of the hydrogen pipe 110 and may be formed inside the cooling cycle device 30, and may be a catalytic device that converts a ratio of ortho-hydrogen to para-hydrogen in a process of liquefying gaseous hydrogen GH2 into liquid hydrogen LH2.

The O-P converter OP, more specifically, for example, may include a first OP converter OP1 formed between the first heat exchanger HX1 and the second heat exchanger HX2, as well as a second OP converter OP2 formed in the hydrogen pipe 110 after passing through the third heat exchanger HX3 and before re-entering it.

Accordingly, for example, hydrogen may have an ortho-hydrogen ratio of 75 percent and a para-hydrogen ratio of 25 percent at room temperature, but hydrogen cooled to a specific temperature while passing through the first heat exchanger HX1 may be in a thermal equilibrium condition with an ortho-hydrogen ratio of 50 percent and a para-hydrogen ratio of 50 percent.

Subsequently, generated conversion heat is cooled by passing through the second heat exchanger HX2, and then ortho-hydrogen and para-hydrogen can finally be converted to a target ratio in the second O-P converter OP2 so that the thermal equilibrium condition of hydrogen that is cooled by passing through the third heat exchanger HX3 is maintained.

The target ratio refers to a ratio at which ortho-hydrogen and para-hydrogen of hydrogen can maintain a thermal equilibrium condition at a target liquefaction temperature, and the target liquefaction temperature may be lower than 20K, and the target ratio of para-hydrogen for maintaining thermal equilibrium condition of hydrogen at target liquefaction temperature (20K or lower) may be 95 to 99.9 percent.

This O-P converter OP, for example, may have a reaction space equipped with a catalyst in contact with hydrogen flowing therein, and may convert a ratio of ortho-hydrogen to para-hydrogen of hydrogen from chemical reaction of the catalyst in contact with hydrogen, and a wide variety of catalysts and catalytic converters with reaction spaces of various structures can all be applied.

As shown in FIG. 1, the hydrogen liquefaction system 100 according to some embodiments of the present disclosure may further comprise a bypass device BP formed in the hydrogen pipe 110 such that gaseous hydrogen GH2 or liquid hydrogen LH2 can optionally bypass the O-P converter OP.

The bypass device BP is a device that can bypass the first O-P converter OP1 and the second O-P converter OP2 so that the hydrogen may either bypass or pass the O-P converter, namely, the first O-P converter OP1 and the second O-P converter OP2, and the bypass device BP may include a first bypass device BP1 formed between the first heat exchanger HX1 and the second heat exchanger HX2 so as to optionally bypass the first O-P converter OP1, and a second bypass device BP2 formed in the hydrogen pipe 110, after the hydrogen pipe 110 passes through the third heat exchanger HX3 and before it re-enters the third heat exchanger HX3 so as to optionally bypass the second O-P converter OP2.

The first bypass device BP1, as shown in FIG. 1, may include a first bypass line L1 that branches from an 'a1' pathway and merges into an 'a2' pathway so as to bypass the first O-P converter OP1; a first bypass valve V1 formed at a front end of the first bypass line L1 so as to optionally open or close any one of the hydrogen pipe 110, which is connected with the first O-P converter OP1, or the first bypass line L1; a second bypass valve V2 formed at a rear end of the first bypass line L1 so as to optionally open or close any one of the hydrogen pipe 110, which is connected with the first O-P converter OP1, or the first bypass line L1; and a controller 40 that applies a control signal to the first bypass valve V1 and the second bypass valve V2 according to a command signal from a program or a user.

The second bypass device BP2 may include: a second bypass line L2 formed as a pathway that can bypass the second O-P converter OP2; a third bypass valve V3 formed at a front end of the second bypass line L2 so as to optionally open or close any one of the hydrogen pipe 110, which is connected with the second O-P converter OP2, or the second bypass line L2; a fourth bypass valve V4 formed at a rear end of the second bypass line L2 so as to optionally open or close any one of the hydrogen pipe 110, which is connected with the second O-P converter OP2, or the second bypass line L2; and a controller 40 that applies a control signal to the third bypass valve V3 and the fourth bypass valve V4 according to a command signal from a program or a user.

Accordingly, the controller 40 may apply a bypass control signal to the valves V1, V2, V3, V4 in a bypass mode such that hydrogen in the hydrogen pipe 110 bypasses so as not to go through the first O-P converter OP1 and the second O-P converter OP2, thereby producing liquid hydrogen quickly and with high efficiency for short-term storage where liquefied liquid hydrogen is consumed within a few days.

Furthermore, the controller 40 may apply an O-P conversion control signal to the valves V1, V2, V3, V4 in an O-P conversion mode such that hydrogen in the hydrogen pipe 110 passes through the first O-P converter OP1 and the second O-P converter OP2 to perform O-P conversion, not going through the first bypass line L1 and the second bypass line L2, thereby producing liquid hydrogen, which is equilibrium hydrogen, through an O-P conversion, although efficiency decreases due to high energy consumption in case that a storage period is significantly long such as two weeks or more or in order to prevent loss of stored liquid for long-distance transportation and the like. In addition to this, the controller 40 may optionally operate the valves V1, V2, V3, V4 in various combinations so that only one of the first O-P converter OP1 and the second O-P converter OP2 can be operated to produce liquid hydrogen with various O-P ratios.

Therefore, according to the present disclosure, it is possible to optionally produce liquid hydrogen for short-term storage or long-term storage at any time with one apparatus depending on situation or need, and through this, the apparatus's response range can be expanded and liquid hydrogen with various O-P ratios can be produced.

Figure 2:
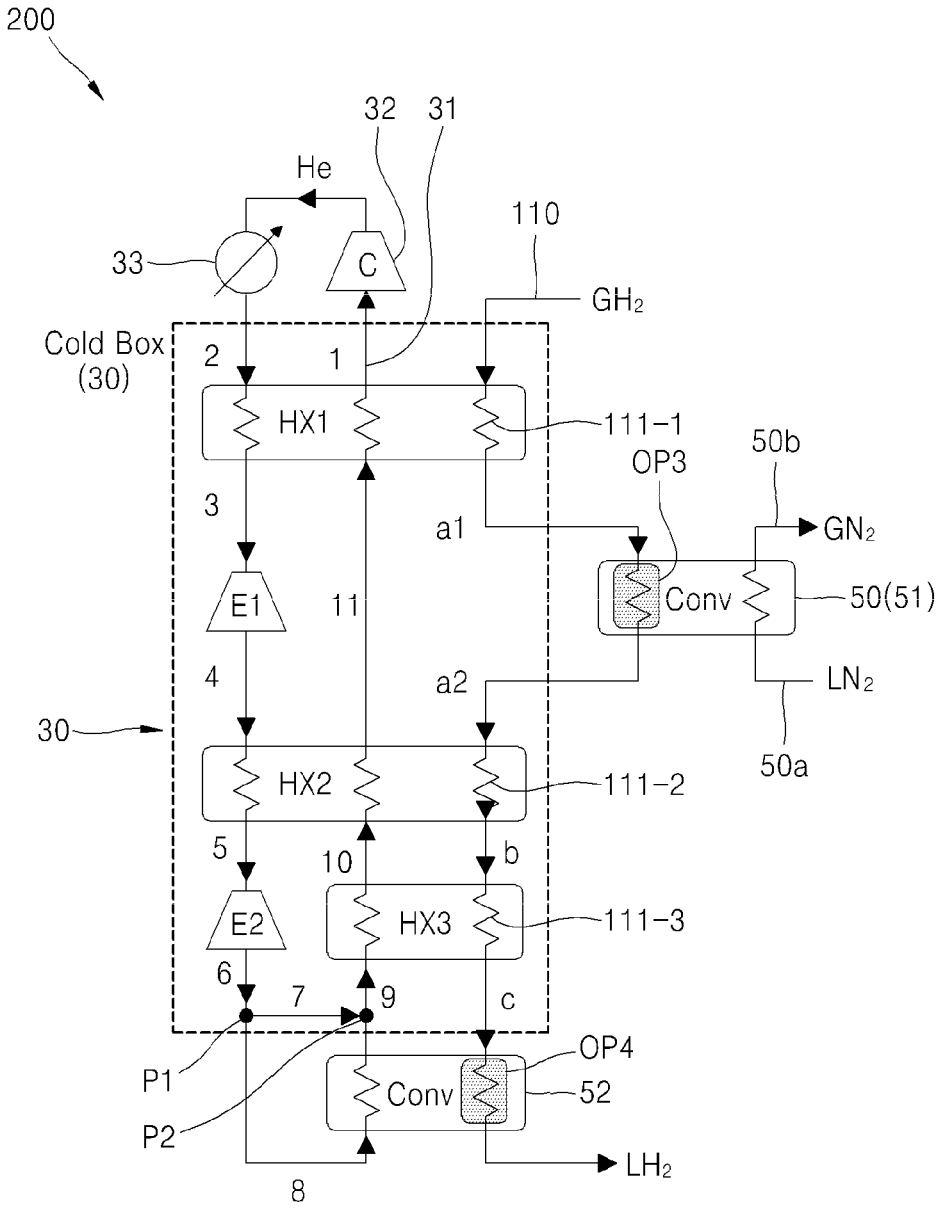
FIG. 2 is a schematic diagram conceptually showing a hydrogen liquefaction system according to other embodiments of the present disclosure.

FIG. 2 is a schematic diagram conceptually showing a hydrogen liquefaction system 200 according to other embodiments of the present disclosure.

The O-P converter OP, for example, as shown in FIG. 2, may be a catalytic converter formed outside the cooling cycle device 30.

The O-P converter OP may be formed in the hydrogen pipe 110 protruding to outside from the cooling cycle device 30, being formed to be surrounded by the heat exchange chamber 50 so as to cool conversion heat that is generated in a O-P conversion process.

The cooling cycle device 30, for example, as shown in FIG. 2, may include: a circulating line 31 in which helium He circulates; a compressor 32 formed in the circulating line 31, compressing helium He; an aftercooler 33 formed in the circulating line 31, cooling compressed helium He to release heat; a first expander E1 formed in the circulating line 31, expanding compressed helium He such that temperature of helium He is firstly lowered; a second expander E2 formed in the circulating line 31, expanding compressed helium He such that temperature of helium He is secondly lowered; a first heat exchanger HX1 formed between the aftercooler 33 and the first expander E1, performing heat exchange with the hydrogen pipe 110; a second heat exchanger HX2 formed between the first expander E1 and the second expander E2, performing heat exchange with the hydrogen pipe 110; and a third heat exchanger HX3 formed between the second expander E2 and the second heat exchanger HX2, performing heat exchange with the hydrogen pipe 110.

The heat exchange chamber, for example, as shown in FIG. 2, may include a first heat exchange chamber 51 formed in a hydrogen pipe 110 exposed to outside to the cooling cycle device 30 between the first heat exchanger HX1 and the second heat exchanger HX2, having a third O-P converter OP3 formed therein; and a second heat exchange chamber 52 formed at a rear end of the hydrogen pipe 110, having a fourth O-P converter OP4 formed therein.

The first heat exchange chamber 51 may be a vacuum chamber, which includes: a liquid nitrogen supply pipe 50*a* formed on one side so as to perform heat exchange with the third O-P converter OP3 by using low-temperature liquid nitrogen LN2 or latent heat that is generated when liquid nitrogen LN2 is vaporized into gaseous nitrogen GN2; and a gaseous nitrogen discharge pipe 50*b* formed on the other side.

In the second heat exchange chamber 52, a circulating line 31, which protrudes to outside of the cooling cycle device 30 between the second expander E2 and the third heat exchanger HX3, and the fourth O-P converter OP4 may be in thermal contact with each other so that the circulating line 31 and the fourth O-P converter OP4 can exchange heat with each other.

The circulating line 31 protruding outside from the cooling cycle device 30 between the second expander E2 and the third heat exchanger HX3 may have a branch point P1 and a junction point P2 so as to be connected in parallel with the circulating line 31, which is connected with the third heat exchanger HX3, between the second expander E2 and the third heat exchanger HX3, such that helium He circulating inside can be distributed in a direction of the third heat exchanger HX3 and in a direction of the second heat exchange chamber 52 and be circulated.

Accordingly, conversion heat generated in the O-P converters OP3, OP4 can be cooled by using the heat exchange chambers 51, 52 that are separately externally formed, thereby preventing a decrease in a liquefaction amount due to the O-P converters OP3, OP4.

Figure 3:
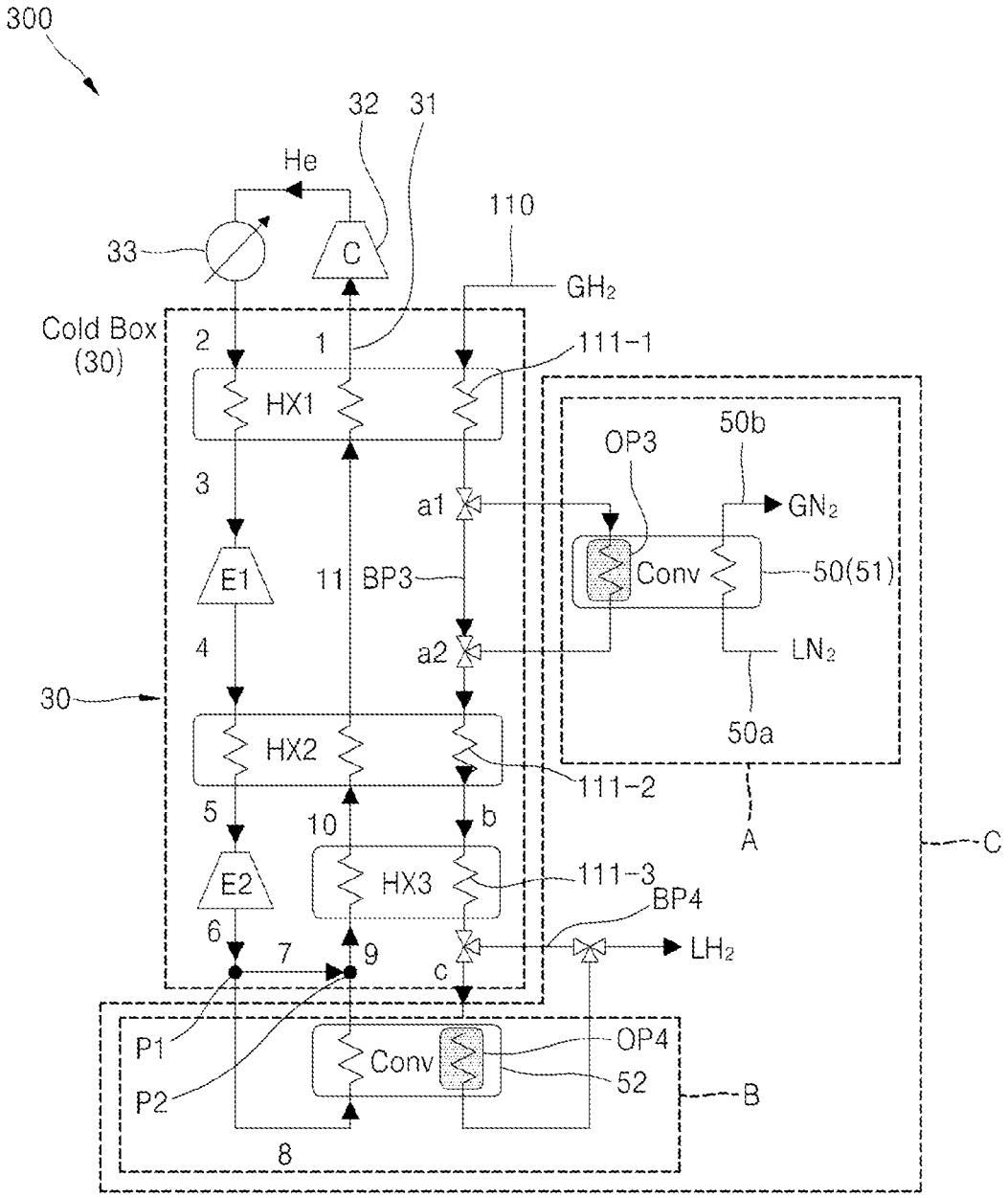
FIG. 3 is a schematic diagram conceptually showing a hydrogen liquefaction system according to other embodiments of the present disclosure.

FIG. 3 is a schematic diagram conceptually showing a hydrogen liquefaction system 300 according to other embodiments of the present disclosure.

As shown in FIG. 3, the heat exchange chamber 50 of the hydrogen liquefaction system 300 according to other embodiments of the present disclosure may, for example, include: a first heat exchange chamber 51, which is formed to be detachable as needed in a hydrogen pipe 110, which is exposed to outside of the cooling cycle device 30, between the first heat exchanger HX1 and the second heat exchanger HX2, as indicated in dotted line A, having a third O-P converter OP3 formed therein; and a second heat exchange chamber 52 formed to be detachable as needed at a rear end of the hydrogen pipe 110 as indicated in dotted line B, having a fourth O-P converter OP4 formed therein.

Alternatively, as shown in dotted line C of FIG. 3, it is possible to form a second Cold Box that includes the first heat exchange chamber 51 and the second heat exchange chamber 52 so as to be detachable with the cooling cycle device 30 (Cold Box).

The bypass device 30, for example, as shown in FIG. 3, may further include: a third bypass device BP3 formed in the hydrogen pipe 110 between the first heat exchanger HX1 and the second heat exchanger HX2 so as to optionally bypass the third O-P converter OP3; and a fourth bypass device BP4 formed at a rear end of the hydrogen pipe 110 so as to optionally bypass the fourth O-P converter OP4.

Accordingly, conversion heat generated in the O-P converters OP3, OP4 can be cooled by using the heat exchange chamber 51, which is separately externally installed, thereby preventing a decrease of a liquefaction amount due to the O-P converters OP3, OP4, and optionally producing liquid hydrogen for short-term storage or long-term storage at any time with one apparatus depending on situation or need, and through this, the apparatus's response range can be expanded and liquid hydrogen with various O-P ratios can be produced.

Figure 4:
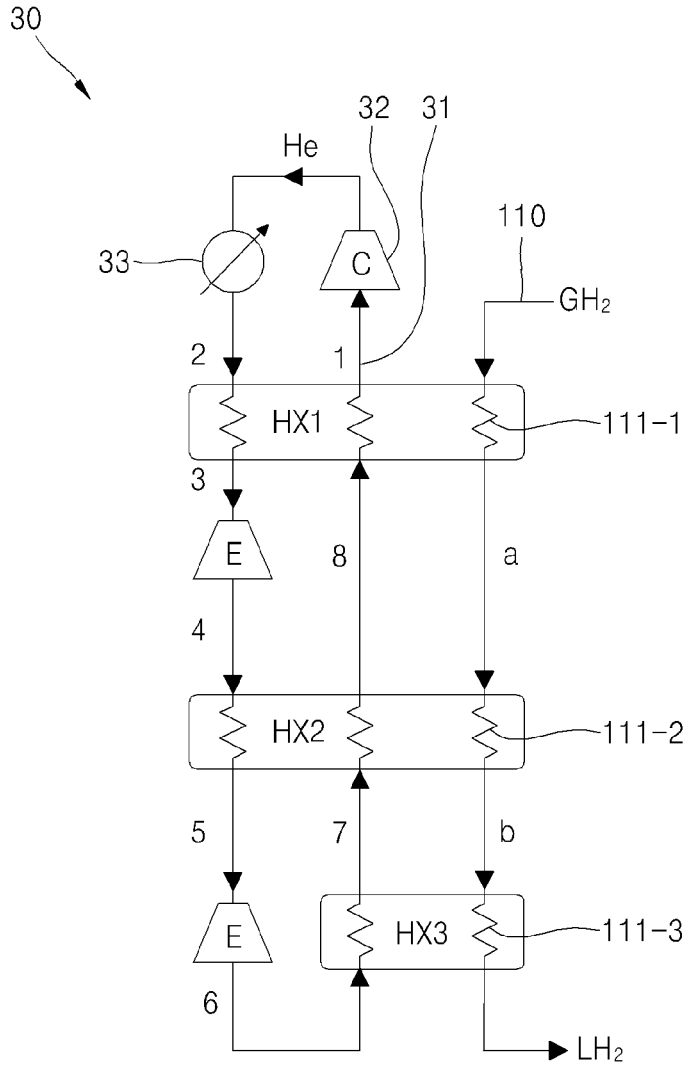
FIG. 4 is a schematic diagram showing a cooling cycle device of the hydrogen liquefaction system of FIG. 1 to FIG. 3.

FIG. 4 is a schematic diagram showing a cooling cycle device 30 of hydrogen liquefaction systems 100, 200, 300 of FIG. 1 to FIG. 3; and FIG. 5 to FIG. 11 are schematic diagrams conceptually showing hydrogen liquefaction systems 400-1000 according to various embodiments of the present disclosure.

FIG. 4 is a cooling cycle device 30, which is a two-stage helium Brayton cycle with no O-P conversion applied, and a liquefaction amount of such cooling cycle device 30 can be assumed to be 1.00.

At this time, as shown in FIG. 5 to FIG. 11, the O-P converter OP may be formed in a wide variety of positions, and this O-P converter OP may be formed in any one or more of following locations: inside of the first heat exchanger HX1, inside of the second heat exchanger HX2, inside of the third heat exchanger HX3 of the cooling cycle device of FIG. 4, in a hydrogen pipe 110 between the first heat exchanger HX1 and the second heat exchanger HX2, or in hydrogen pipe 110 between the second heat exchanger HX2 and the third heat exchanger HX3, or a combination of these locations.

Figure 5:
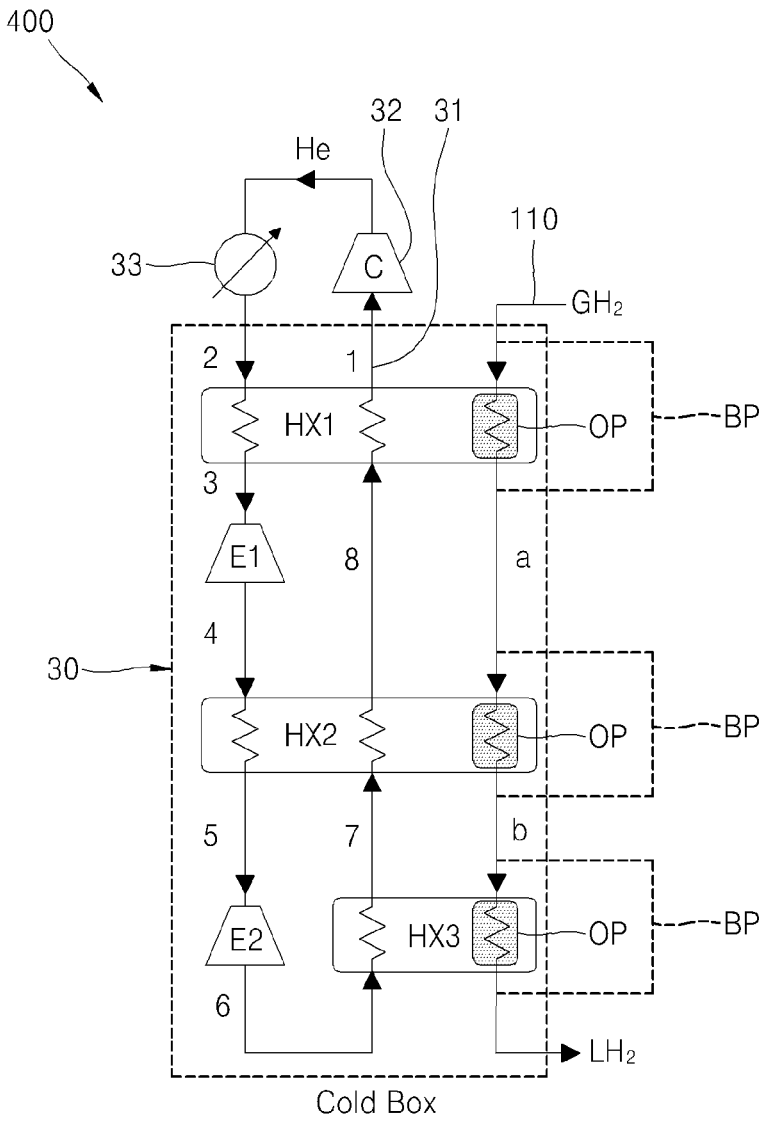
FIG. 5 to FIG. 11 are schematic diagrams conceptually showing hydrogen liquefaction systems according to various embodiments of the present disclosure, respectively.

That is, the cooling cycle device 30 of the hydrogen liquefaction system 400 of FIG. 5 may have a total of three O-P converters OP formed in following locations: inside the first heat exchanger HX1, inside the second heat exchanger HX2, and inside the third heat exchanger HX3, respectively; and a liquefaction amount in this case may be 0.845.

Figure 6:
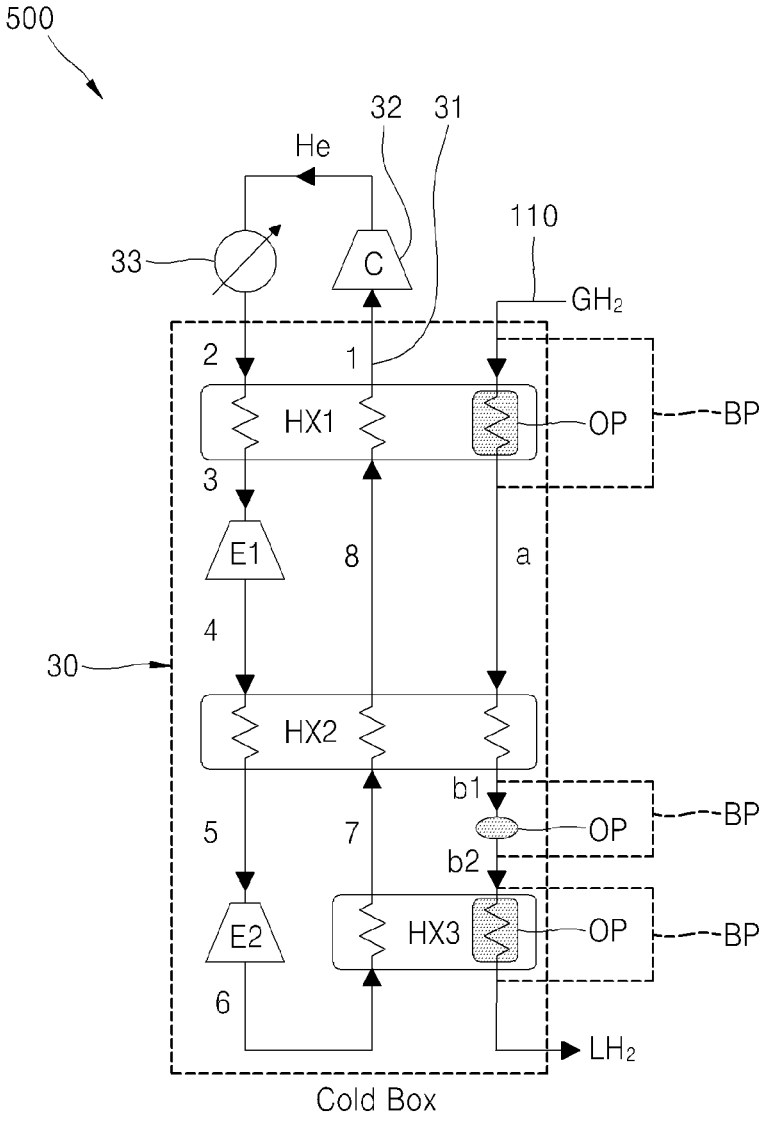

The cooling cycle device 30 of the hydrogen liquefaction system 500 of FIG. 6 may have a total of three O-P converters OP formed in following locations: inside the first heat exchanger HX1, in the hydrogen pipe 110 between the second heat exchanger HX2 and the third heat exchanger HX3, and inside the third heat exchanger HX3, respectively; and a liquefaction amount in this case may be 0.839.

Figure 7:
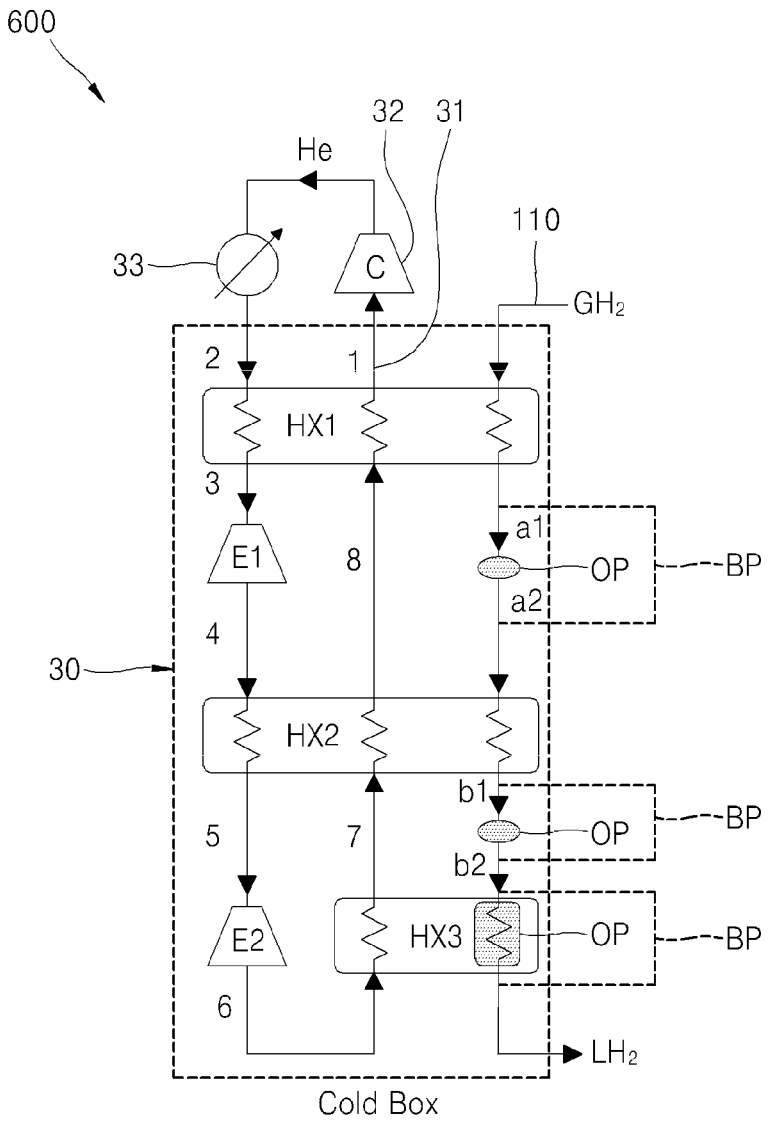

The cooling cycle device 30 of the hydrogen liquefaction system 600 of FIG. 7 may have a total of three O-P converters OP formed in following locations: in the hydrogen pipe 110 between the first heat exchanger HX1 and the second heat exchanger HX2, in the hydrogen pipe 110 between the second heat exchanger HX2 and the third heat exchanger HX3, and inside the third heat exchanger HX3, respectively; and a liquefaction amount in this case may be 0.808.

Figure 8:
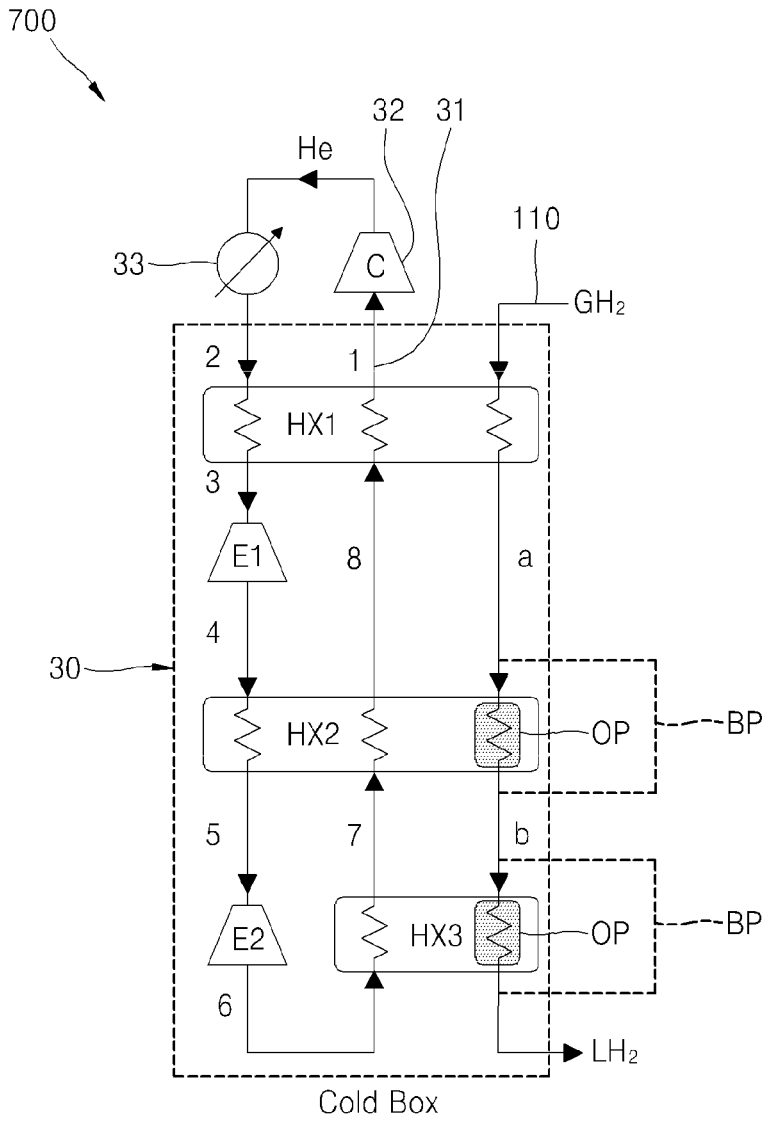

The cooling cycle device 30 of the hydrogen liquefaction system 700 of FIG. 8 may have a total of two O-P converters OP formed in following locations: inside the second heat exchanger HX, and inside the third heat exchanger HX3, respectively; and a liquefaction amount in this case may be 0.792.

Figure 9:
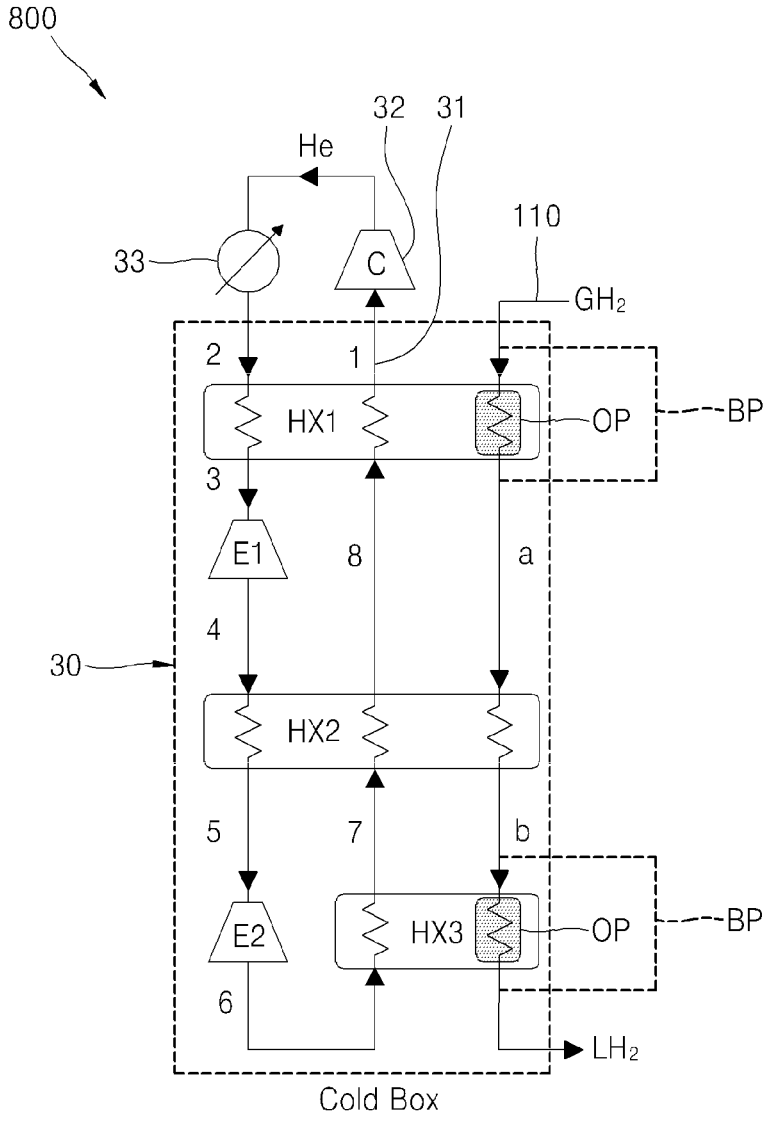

The cooling cycle device 30 of the hydrogen liquefaction system 800 of FIG. 9 may have a total of two O-P converters OP formed in following locations: inside the first heat exchanger HX1 and inside the third heat exchanger HX3, respectively; and a liquefaction amount in this case may be 0.791.

Figure 10:
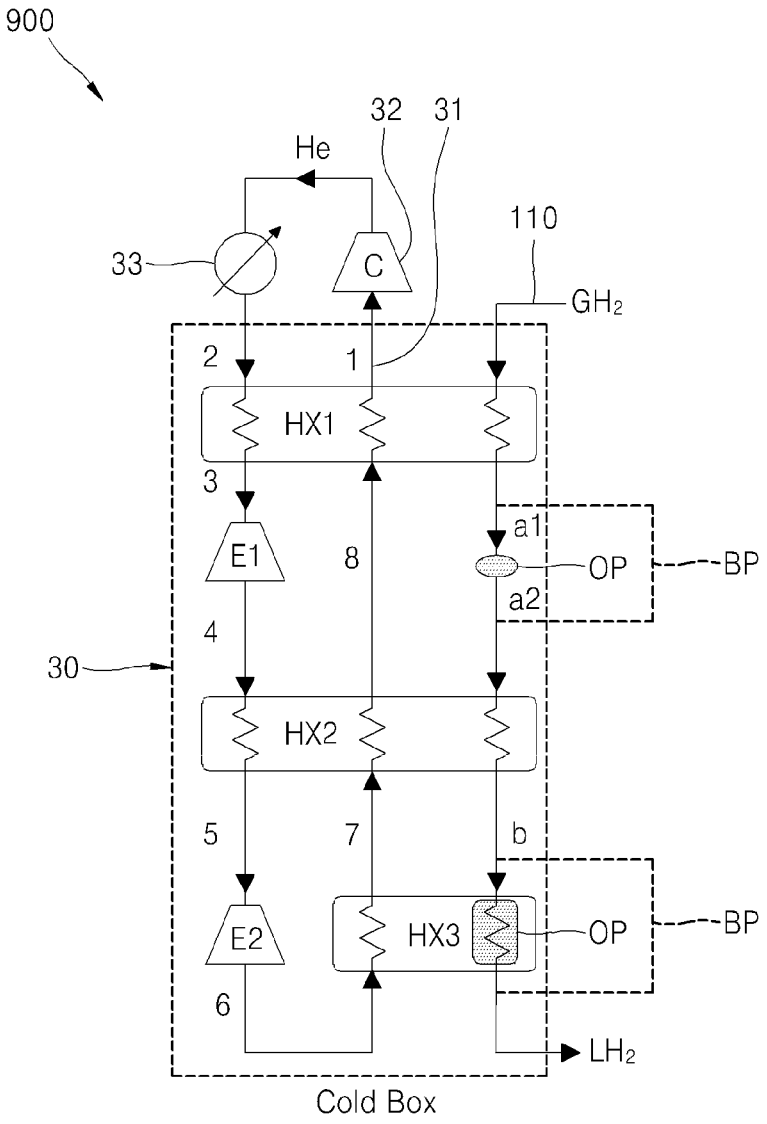

The cooling cycle device 30 of the hydrogen liquefaction system 900 of FIG. 10 may have a total of two O-P converters OP formed in following locations: in the hydrogen pipe 110 between the first heat exchanger HX1 and the second heat exchanger HX2 and inside the third heat exchanger HX3, respectively; and a liquefaction amount in this case may be 0.778.

Figure 11:
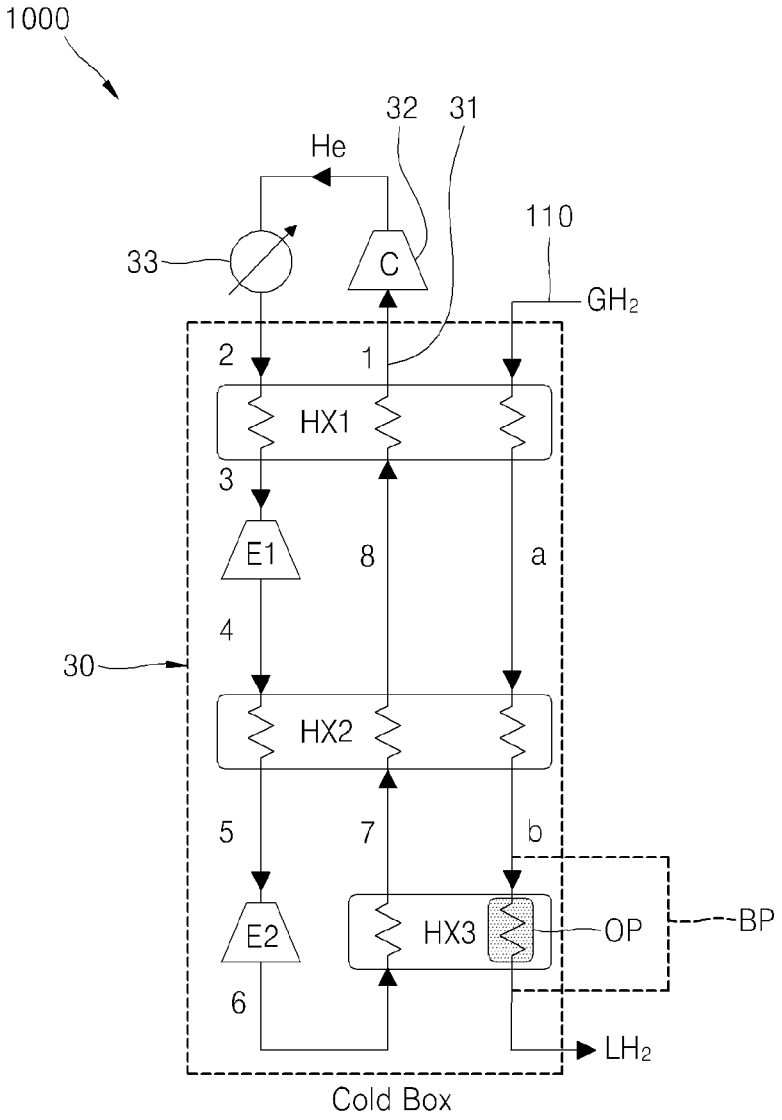

The cooling cycle device 30 of the hydrogen liquefaction system 1000 of FIG. 11 may have one O-P converter OP formed inside the third heat exchanger HX3; and a liquefaction amount in this case may be 0.735.

Each of these O-P converters shown in FIG. 5 to FIG. 11 may be additionally installed with bypass devices so as to bypass the O-P converters.

Therefore, according to the present disclosure, as shown in FIG. 5 to FIG. 11, O-P converters OP and bypass devices BP can be installed in various locations in various numbers to be operated as the cooling cycle device 30 of FIG. 4 in a bypass mode to produce a hydrogen liquefaction amount of 1.00; and in an O-P conversion mode, as shown in FIG. 5 to FIG. 11, liquefied hydrogen can be produced in various ways with various liquefaction amounts.

Accordingly, it is possible to produce liquid hydrogen in a normal state, which is advantageous for short-term storage, in a bypass mode by allowing an O-P conversion process to be optionally performed as needed using a bypass device in a hydrogen liquefaction process; produce liquid hydrogen in equilibrium condition, which is advantageous for long-term storage or long-distance transportation, in an O-P conversion mode; and further increase conversion efficiency by cooling O-P conversion heat by using an external heat exchange chamber 50.

Figure 12:
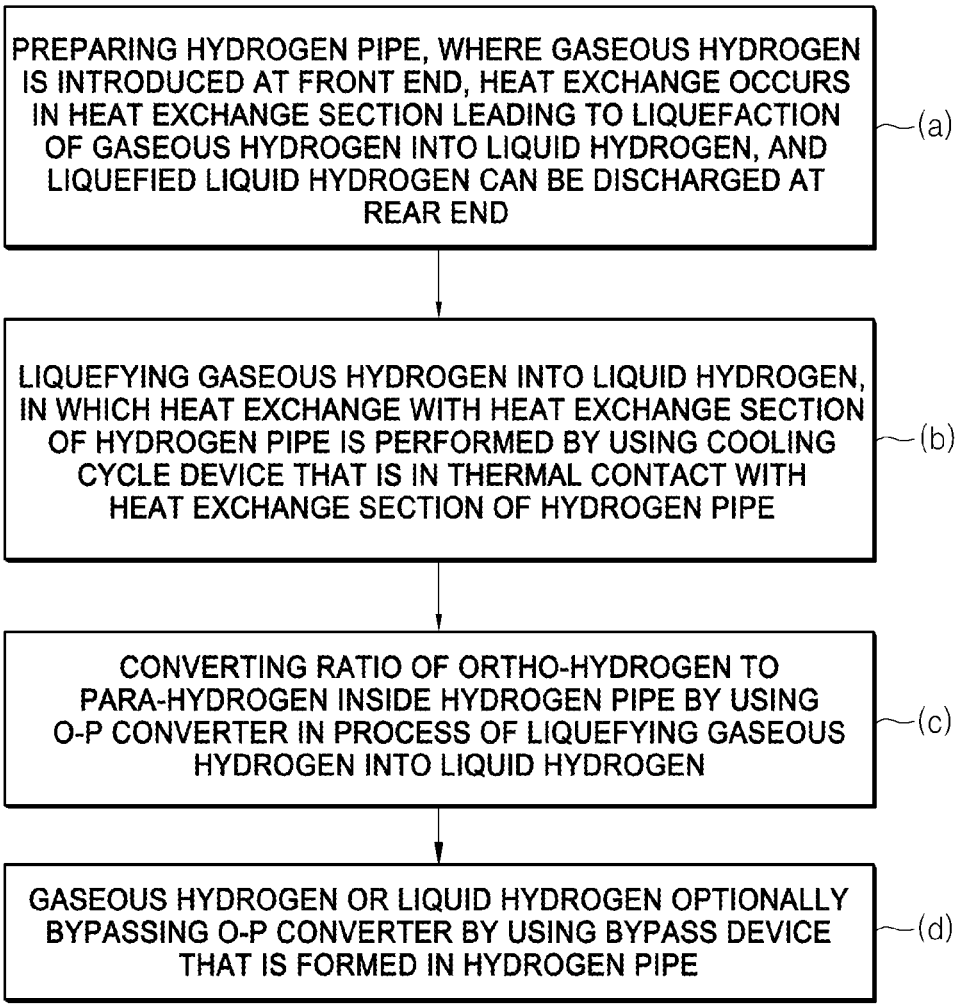
FIG. 12 is a flowchart showing a hydrogen liquefaction method according to some embodiments of the present disclosure.

FIG. 12 is a flowchart showing a hydrogen liquefaction method according to some embodiments of the present disclosure.

As shown in FIG. 1 to FIG. 12, the hydrogen liquefaction method according to some embodiments of the present disclosure may comprise: (a) preparing a hydrogen pipe, where gaseous hydrogen GH2 is introduced at a front end, heat exchange occurs in heat exchange sections 111-1 to 111-3 leading to liquefaction of gaseous hydrogen GH2 into liquid hydrogen LH2, and liquefied liquid hydrogen LH2 can be discharged at a rear end; (b) liquefying gaseous hydrogen GH2 into liquid hydrogen LH2, in which heat exchange with the heat exchange sections 111-1 to 111-3 of the hydrogen pipe 110 is performed by using a cooling cycle device 30 that is in thermal contact with the heat exchange sections 111-1 to 111-3 of the hydrogen pipe 110; and (c) converting a ratio of ortho-hydrogen to para-hydrogen inside the hydrogen pipe 110 by using an O-P converter OP in a process of liquefying gaseous hydrogen GH2 into liquid hydrogen LH2.

Here, the hydrogen liquefaction method according to some embodiments of the present disclosure may further comprise: before or after (c), (d) gaseous hydrogen GH2 or liquid hydrogen LH2 optionally bypassing the O-P converter OP by using a bypass device BP that is formed in the hydrogen pipe 110.

Although the above has shown and described various embodiments of the present disclosure, the present disclosure is not limited to the specific embodiments described above. The above-described embodiments can be variously modified and implemented by those skilled in the art to which the present disclosure pertains without departing from the gist of the present disclosure claimed in the appended claims, and these modified embodiments should not be understood separately from the technical spirit or scope of the present disclosure. Therefore, the technical scope of the present disclosure should be defined only by the appended claims.

In the embodiments disclosed herein, arrangement of illustrated components may vary depending on requirements or environment in which the disclosure is implemented. For example, some components may be omitted or some components may be integrated and implemented as one.

What is claimed is:

1. A hydrogen liquefaction system, comprising:

a hydrogen pipe, where gaseous hydrogen is introduced at a front end, heat exchange occurs in a heat exchange section leading to liquefaction of gaseous hydrogen into liquid hydrogen, and liquefied liquid hydrogen can be discharged at a rear end;

a cooling cycle device that is in thermal contact with the heat exchange section of the hydrogen pipe so as to perform heat exchange with the heat exchange section of the hydrogen pipe such that gaseous hydrogen can be liquefied into liquid hydrogen; and an Ortho-Para (O-P) converter formed in the hydrogen pipe, converting a ratio of ortho-hydrogen to para-hydrogen in a process of liquefying gaseous hydrogen into liquid hydrogen; and a bypass device formed in the hydrogen pipe such that gaseous hydrogen or liquid hydrogen can optionally bypass the O-P converter, wherein the O-P converter is formed in the hydrogen pipe that protrudes to outside from the cooling cycle device, being formed to be surrounded by a heat exchange chamber, wherein the heat exchange chamber is a vacuum chamber, which includes: a liquid nitrogen supply pipe formed on one side so as to perform heat exchange by using low-temperature liquid nitrogen or latent heat that is generated when liquid nitrogen is vaporized into gaseous nitrogen; and a gaseous nitrogen discharge pipe formed on the other side, and whereby heat generated from the converting of the ratio of ortho-hydrogen to para-hydrogen is thermally isolated from the cooling cycle device so as to reduce deterioration of liquefaction efficiency.

2. The hydrogen liquefaction system according to claim 1, wherein the cooling cycle device includes:

a circulating line in which helium circulates;

a compressor formed in the circulating line, compressing helium;

an aftercooler formed in the circulating line, cooling compressed helium to release heat;

a first expander formed in the circulating line, expanding compressed helium such that temperature of helium is firstly lowered;

a second expander formed in the circulating line, expanding compressed helium such that temperature of helium is secondly lowered;

a first heat exchanger formed between the aftercooler and the first expander, performing heat exchange with the hydrogen pipe; and a second heat exchanger formed between the first expander and the second expander, performing heat exchange with the hydrogen pipe.

3. The hydrogen liquefaction system according to claim 2, wherein the O-P converter includes:

a first O-P converter formed between the first heat exchanger and the second heat exchanger, and the bypass device includes:

a first bypass device formed between the first heat exchanger and the second heat exchanger so as to optionally bypass the first O-P converter.

4. The hydrogen liquefaction system according to claim 3, wherein the first bypass device includes:

a first bypass line that bypasses the first O-P converter;

a first bypass valve formed at a front end of the first bypass line so as to optionally open or close any one of the hydrogen pipe that is connected to the first O-P converter, or the first bypass line; and a second bypass valve formed at a rear end of the first bypass line so as to optionally open or close any one of the hydrogen pipe that is connected to the first O-P converter, or the first bypass line.

5. The hydrogen liquefaction system according to claim 4, wherein the cooling cycle device further includes:

a third heat exchanger formed between the second expander and the second heat exchanger, performing heat exchange with the hydrogen pipe.

6. The hydrogen liquefaction system according to claim 5, wherein the O-P converter further includes:

a second O-P converter formed in the hydrogen pipe, after the hydrogen pipe passes through the third heat exchanger and before it re-enters the third heat exchanger, and the bypass device further includes:

a second bypass device formed in the hydrogen pipe, after the hydrogen pipe passes through the third heat exchanger and before it re-enters the third heat exchanger, so as to optionally bypass the second O-P converter.

7. The hydrogen liquefaction system according to claim 6, wherein the second bypass device includes:

a second bypass line that bypasses the second O-P converter;

a third bypass valve formed at a front end of the second bypass line so as to optionally open or close any one of the hydrogen pipe that is connected to the second O-P converter, or the second bypass line; and a fourth bypass valve formed at a rear end of the second bypass line so as to optionally open or close any one of the hydrogen pipe that is connected to the second O-P converter, or the second bypass line.

8. The hydrogen liquefaction system according to claim 1, wherein the cooling cycle device includes:

a circulating line in which helium circulates;

a compressor formed in the circulating line, compressing helium;

an aftercooler formed in the circulating line, cooling compressed helium to release heat;

a first expander formed in the circulating line, expanding compressed helium such that temperature of helium is firstly lowered;

a second expander formed in the circulating line, expanding compressed helium such that temperature of helium is secondly lowered;

a first heat exchanger formed between the aftercooler and the first expander, performing heat exchange with the hydrogen pipe;

a second heat exchanger formed between the first expander and the second expander, performing heat exchange with the hydrogen pipe; and a third heat exchanger formed between the second expander and the second heat exchanger, performing heat exchange with the hydrogen pipe.

9. The hydrogen liquefaction system according to claim 8, wherein the heat exchange chamber includes:

a first heat exchange chamber formed to be detachable in the hydrogen pipe, which is exposed to outside of the cooling cycle device, between the first heat exchanger and the second heat exchanger, having a third O-P converter formed therein; and a second heat exchange chamber formed to be detachable at the rear end of the hydrogen pipe or formed to be detachable with the cooling cycle device by forming a second Cold Box with the first heat exchange chamber, having a fourth O-P converter formed therein.

10. The hydrogen liquefaction system according to claim 9, wherein the second heat exchange chamber is in thermal contact with a circulating line, which protrudes to outside of the cooling cycle device, between the second expander and the third heat exchanger so as to perform heat exchange with the circulating line, or forms a second Cold Box with the first heat exchange chamber to be detachable in the cooling cycle device.

11. The hydrogen liquefaction system according to claim 10, wherein the circulating line, which protrudes to outside of the cooling cycle device between the second expander and the third heat exchanger, has a branch point and a junction point so as to be connected in parallel with the circulating line, which is connected with the third heat exchanger, between the second expander and the third heat exchanger.

12. The hydrogen liquefaction system according to claim 11, wherein the bypass device further includes:

a third bypass device formed in the hydrogen pipe between the first heat exchanger and the second heat exchanger so as to optionally bypass the third O-P converter; and a fourth bypass device formed at a rear end of the hydrogen pipe so as to optionally bypass the fourth O-P converter.

13. The hydrogen liquefaction system according to claim 1, wherein the O-P converter is formed in any one or more of following locations: inside of the first heat exchanger, inside of the second heat exchanger, inside of the third heat exchanger of the cooling cycle device, in the hydrogen pipe between the first heat exchanger and the second heat exchanger, or in the hydrogen pipe between the second heat exchanger and the third heat exchanger, or a combination of these locations.

* * * * *